United States Patent [19]

Carley et al.

[11] 4,435,299

[45] Mar. 6, 1984

[54] PREPARATION OF HIGH DROPPING POINT LITHIUM COMPLEX SOAP GREASE

[75] Inventors: Don A. Carley, Houston; Arnold C. Witte, Jr., Port Neches; William B. Green, Nederland; Kermit W. Doerr, Katy, all of Tex.

[73] Assignee: Texaco Inc., White Plains, N.Y.

[21] Appl. No.: 385,744

[22] Filed: Jun. 7, 1982

[51] Int. Cl.[3] ..... C10M 5/14

[52] U.S. Cl. ..... 252/41; 252/18; 252/25; 252/42.1

[58] Field of Search ..... 252/41, 25, 18, 42.1

[56] References Cited

U.S. PATENT DOCUMENTS

| | | | |
|---|---|---|---|
| 3,681,242 | 8/1972 | Gilani et al. | 252/41 |
| 3,791,973 | 2/1974 | Gilani et al. | 252/41 |
| 3,929,651 | 12/1975 | Murray et al. | 252/41 |

*Primary Examiner*—Jacqueline V. Howard

*Attorney, Agent, or Firm*—Carl G. Ries; Robert A. Kulason; Alan M. Kamel

[57] ABSTRACT

A high temperature multipurpose grease is prepared from the lithium soap of a $C_{12}$ to $C_{24}$ hydroxy fatty acid, (e.g. 12-hydroxy stearic acid) and a dilithium soap of a $C_4$ to $C_{12}$ dicarboxylic acid, (e.g. dilithium azelate) wherein the acid mole ratios range from 3:1 to 0.5:1 respectively under carefully controlled processing conditions including controlled alkali addition and one step heating.

20 Claims, No Drawings

PREPARATION OF HIGH DROPPING POINT LITHIUM COMPLEX SOAP GREASE

BACKGROUND OF THE INVENTION

1. Field of the Invention

This invention is concerned with the preparation of a lithium complex soap grease having a high dropping point. Lithium soap greases have been known and widely used for many years. The principal advantages of a lithium soap grease have included high water resistance and ease of dispersion of the soap in all types of lubricating oil base stocks. While the lithium soaps used as thickening agents for these greases can be prepared by reaction of lithium hydroxide or other lithium base with conventional high molecular weight fatty acids, lithium 12-hydroxy stearic acid and the lithium soaps of related hydroxy fatty acids have been particularly useful because of their great mechanical stability.

There are many fields of application of grease compositions where a high dropping point is required, as for example in the lubrication of automotive disc brake wheel bearings. Such disc brakes are used in modern locomotives.

The prior art discloses batch processes for preparing high dropping point lithium complex soap greases. One known process requires separate saponification steps for the monocarboxylic fatty acid and for the dicarboxylic fatty acid components. In another process, the monocarboxylic acid and dicarboxylic acid components are saponified together but this process requires at least two distinct heating steps following the saponification step in order to complete grease formation.

Improved complex soap process for preparing high dropping point lithium greases, having fewer steps would be commerically advantageous and desirable.

An object of this invention is to provide a process for preparing lithium complex soap greases which will provide substantial advantages in convenience and economy over known methods.

2. Description of the Prior Art

U.S. Pat. No. 3,681,242 discloses a batch process for preparing a high dropping point lithium complex soap grease which includes two distinct heating stages after saponification. The lithium soap is prepared from a mixture of $C_{12}$ to $C_{24}$ hydroxy fatty acid and a $C_4$ to $C_{12}$ dicarboxylic acid.

U.S. Pat. No. 3,791,973 discloses a batch process for preparing a high dropping point lithium complex soap grease by a particular sequence of steps which includes the separate formation of the lithium soaps of a $C_{12}$ to $C_{24}$ hydroxy fatty acid and of a $C_4$ to $C_{12}$ aliphatic dicarboxylic acid.

SUMMARY OF THE INVENTION

In accordance with the present invention, a lithium complex soap grease having a dropping point in excess of 500° F. is prepared by a process which comprises the steps of: (1) dissolving from 3 to 0.5 moles of a $C_{12}$ to $C_{24}$ hydroxy fatty acid per one mole of a $C_4$ to $C_{12}$ aliphatic dicarboxylic acid in a lubricating oil to form an oil-acid mixture, in which the amount of oil employed comprises from about 30 to 50 weight percent of the total amount of oil employed in the finished composition, (2) adjusting the oil and acid mixture to a temperature of below about the boiling temperature of the water; (3) adding at a controlled rate of less than about 0.30 lbs./minute per 100 lb. batch of finished grease composition, a concentrated aqueous solution of 8–10 weight percent lithium hydroxide in an amount slightly in excess of that required to neutralize the acids; (4) maintaining the reaction conditions for a period of time sufficient to obtain substantially complete saponification between the fatty acids and lithium hydroxide; (5) dehydrating the mixture of the lubricating oil and lithium complex soap; (6) heating the mixture until it is uniformly at a temperature from about 390° F. to about 430° F.; (7) rapidly cooling the mixture to about 375° F. or below by quenching it with additional lubricating oil and finally (8) incorporating the remainder of the lubricating oil into said grease composition.

DESCRIPTION OF THE PREFERRED EMBODIMENTS

This invention is concerned with a process for the preparation of a lithium complex soap grease having a dropping point above 500° F. The thickener system of the grease is a combination of a lithium soap of a $C_{12}$ to $C_{24}$ hydroxy fatty acid and a lithium soap of a $C_4$ to $C_{12}$ aliphatic dicarboxylic acid. The key sequence of steps included in this invention is:

(1) Dissolving from 3 to 0.5 moles of a $C_{12}$ to $C_{24}$ hydroxy fatty acid per one mole of a $C_4$ to $C_{12}$ aliphatic dicarboxylic acid by stirring the acids into about 30 to 50 weight percent of the total amount of base oil to be used in the finished grease;

(2) Adjusting the temperature of the oil and acid mixture to below about the boiling temperature of the water;

(3) Adding slowly at a controlled rate of less than 0.30 lbs./minute per 100 lb. of finished grease product, a concentrated aqueous solution of approximately 8–10 weight percent of lithium hydroxide usually in an amount slightly in excess of that required to neutralize the acids.

(4) Maintaining the reaction conditions for a period of time sufficient to obtain at least substantially complete saponification between the fatty acids and the lithium hydroxide;

(5) Dehydrating the mixture of lubricating oil and lithium complex soap;

(6) Heating the mixture until it is uniformly at a temperature from about 390° F. to about 430° F.;

(7) Rapidly cooling the mixture to about 375° F. or below by quenching it with approximately 5 to 25 weight percent of the total amount of lubricating oil employed in the finished composition;

(8) Incorporating the remainder of the lubricating oil into the said grease composition.

The hydroxy fatty acid employed in preparing the grease of this invention will have from about 12 to 24, or more usually about 16 to 20, carbon atoms, and will preferably be a hydroxy-stearic acid, e.g. 9-hydroxy, 10-hydroxy, or 12-hydroxy, stearic acid, most preferably 12-hydroxy stearic acid. Other acids which can also be used include: ricinoleic acid, 12-hydroxy tetradecanoic acid, 10-hydroxy tetradecenoic acid, 12-hydroxy hexadecanoic acid, 8-hydroxy hexadecenoic acid, 12-hydroxy icosanic acid and 16-hydroxy icosanic acid.

The dicarboxylic acid used in the greases of this invention will have from 4 to 12 carbon atoms, preferably 6 to 10 carbon atoms. Such acids include succinic, glutaric, adipic, suberic, pimelic, azelaic, dodecanedioic, and sebacic acids. Azelaic acid is preferred.

The proportion of hydroxy fatty acid to dicarboxylic acid will be in the range of about 3:1 to 0.5:1 moles respectively with a preferred mole ratio range of about 2:1 to 0.5:1 and a most preferred mole ratio of about 1.6:1 moles respectively.

The lubricating oils forming the major constituent of these greases may be any oils of lubricating characteristics which are suitable for use in lubricating greases generally. Mineral lubricating oil base stocks used in preparing the greases can be any conventionally refined base stocks derived from paraffinic, naphthenic and mixed base crudes. Such oils include particularly the conventional mineral lubricating oils having Saybolt Universal viscosities in the range from about 35 seconds to about 300 seconds at 210° F., which may be either naphthenic or paraffinic in type or blends of different oils. When a blend of lubricating oils is employed to make the grease composition, the oils may be blended separately prior to use in the grease making process or they may be blended as used in the grease making process as done in Example I. The latter procedure permits use of an oil in the initial stage of the grease preparation in which the fatty acids dissolve more readily, and is also more convenient where blended oils are not readily available. The preferred mineral oils are those having Saybolt Universal viscosities in the range from about 60 seconds to about 80 seconds at 210° F., which may be blends of lighter and heavier oils in the lubricating oil viscosity range.

Synthetic lubricating oils, which may be preferred for obtaining greases having special properties required for certain types of lubricating service, include oils prepared by cracking and polymerizing products of the Fischer Tropsch process and the like, as well as other synthetic oleaginous compounds such as diesters, polyesters, polyethers, etc., having viscosities within the lubricating oil viscosity range. Examples of suitable diesters include the aliphatic dicarboxylic acid diesters, such as di-2-ethylhexyl sebacate, di(secondary amyl) sebacate, di-2-ethylhexyl azelate, di-iso-octyladipate, etc. Other synthetic oils that can be used include synthetic hydrocarbons such as alkyl benzenes, e.g. alkylate bottoms from the alkylation of benzene with tetrapropylene, or the copolymers of ethylene and propylene; silicon oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethyl carbonate to form a half ester followed by reaction of the latter with tetraethylene glycol, etc.

The total soap content of the grease of the present invention will be in the range of from about 2 to 30 weight percent and preferably from about 5 to 20 weight percent and most preferably about 10–14 weight percent.

According to the present invention a $C_{12}$ to $C_{24}$ hydroxy fatty acid and a $C_4$ to $C_{12}$ aliphatic dicarboxylic acid are dissolved by stirring and heating into about from 20 to 50 weight percent and preferably in about 40 weight percent of the total amount of a suitable base oil to be used in preparing the grease. Preferably the hydroxy fatty acid has 16 to 20 carbon atoms and the dicarboxylic acid has from 6 to 10 carbon atoms, with the most preferred acids being 12-hydroxy stearic acid and azelaic acid respectively. The mole ratio range of hydroxy fatty acid to dicarboxylic acid is approximately 3:1 to about 0.5:1 and preferably 2:1 to 0.5:1 with approximately 8:5 moles respectively being the most preferred mole ratio. When azelaic acid is employed usually the temperature necessary for dissolution of the acids is from about 240° F. to about 250° F. The temperature of the oil and acid mixture is then brought to below the boiling temperature of water, preferably to about 200° to 210° F., range, and a concentrated aqueous solution of approximately 8 to 10 weight percent and preferably 9.4 weight percent of lithium hydroxide is added at a controlled rate. This rate is usually below about 0.30 lbs./minute per 100 lbs. of finished grease product and preferably from about 0.05 to about 0.25 lbs./minute per 100 lbs. of finished grease product with the most preferred rate being about 0.15 lbs./minute per 100 lbs. of finished grease product. The rate of alkali addition is a critical feature of this invention and it is important that it be carefully controlled. The amount of lithium hydroxide solution added is usually an amount slightly in excess of that required to neutralize the acids. While the alkali is being added the mixture may be slowly circulated at a rate of 1 lb/min for every 2 to 10 lbs of mixture in the kettle giving 1 kettle volume turnover every 2 to 10 minutes and preferably at a rate of 1 lb/min for every 2 to 5 lbs of mixture in the kettle which gives 1 kettle volume turnover every 2 to 5 minutes. Most preferably the circulation rate is 1 lb/min for approximately every 3 lbs of mixture in the kettle giving 1 kettle volume turnover approximately every 3 minutes. After the alkali addition is complete, the mixture is maintained at a temperature below the boiling temperature of water, i.e. 212° F. and preferably at from 200° F. to 210° F., until saponification is substantially complete which may take from about 15 to about 45 minutes and more likely about 30 minutes. Following saponification the oil and lithium soap mixture are dehydrated. This is a accomplished by heating the mixture to from about 220° to about 250° F. After dehydration the temperature is further raised until the mixture is uniformly at from about 390° F. to about 430° F. The minimum heating time is usually 15 to 30 minutes and frequently an hour or more. The mixture is then rapidly cooled to below about 375° F. by quenching it with additional oil i.e. approximately 5 to 25 percent and preferably 5–10 percent of the total amount of lubricating oil employed in the finished grease composition. The mixture may be further cooled by an external cooling means such as an insulating jacket or heat exchanger. The remainder of the base oil and any desired additives may be incorporated into the mixture as it cools. Upon completion of the oil addition, the mixture may be milled. Although milling is not necessary for the preparation of a satisfactory grease according to the process of this invention, it improves the consistency of the grease and therefore greases made according to the process of this invention are usually milled.

The nature of this invention and the manner in which it is practiced will be better understood when reference is made to the following examples which include preferred embodiments.

EXAMPLE 1

A grease kettle was charged with 34.90 lbs. of a deasphalted, solvent refined and dewaxed paraffin base residual oil having a viscosity of 160 SUS at 210° F., 7.85 lbs. 12-hydroxystearic acid, and 3.77 lbs. azelaic acid. The mixture was heated with stirring to 250° F. to dissolve the acids. After cooling to 200°–210° F., 17.76 lbs. concentrated aqueous lithium hydroxide solution containing 1.67 lbs. lithium hydroxide was added at 0.15 lb./minute while slowly circulating the mixture at a rate of 1 lb/min for every 3 lbs of batch giving 1 kettle volume turnover approximately every 3 minutes. After completion of the lithium hydroxide addition, the mixture was held at 200°–210° F. for 30 minutes to complete saponification. Next, the mixture was heated to bring about dehydration, and then heating was continued until a temperature of 410°–420° F. was reached. After holding the mixture at 410°–420° F. for 30 minutes, it was quenched with 7.0 lbs. initial batch of base oil and further cooled by an external means to 325° F., when 46 lbs. of additional oil (a 1.7:1 ratio blend of the oil used in the initial charge of the batch and a solvent refined and dewaxed paraffin base distillate oil with a viscosity of 180 SUS at 100° F.) was added to the batch at 0.3 lb./minute. Upon completion of oil addition, the mixture was milled using a conventional Charlotte mill.

The following data was obtained for the grease prepared by the above procedure:

Dropping Point, °F.: 500+ck 500+
Worked Penetration at 77° F.: 266
Soap, Wt % (Calculated): 12.0

The following examples show that the high dropping point is not obtained if the rate of alkali addition is too fast or if all of the alkali is added at one time.

COMPARATIVE EXAMPLE 1

Example 1 was repeated except that the aqueous lithium hydroxide was added at the rate of 0.50 lb./minute. The prepared grease gave the following data:

Dropping Point, °F.: 484
Worked Penetration at 77° F.: 282
Soap, Wt % (Calculated): 12.0

COMPARATIVE EXAMPLE 2

Example 1 was again repeated except that the aqueous lithium hydroxide was added all at once. The data obtained from that batch is as follows:

Dropping Point, °F.: 435
Worked Penetration at 77° F.: 285
Soap, Wt % (Calculated): 12.0

Various other additives may be incorporated into the grease composition of this invention, as is understood by those skilled in this art. Such additives include, but are not limited to, dyes, antioxidants such as phenylalphanaphthylamine, rust inhibitors such as barium dinonyl naphthalene sulfonate, odor modifiers, tackiness agents, extreme pressure agents, and the like.

What is claimed is:

1. A process for preparing a lithium soap grease having a dropping point above 500° F. which comprises the steps of:
   (a) dissolving a $C_{12}$ to $C_{24}$ hydroxy fatty acid and a $C_4$ to $C_{12}$ aliphatic dicarboxylic acid in approximately a 3:1 to 0.5:1 mole ratio range in a lubricating oil to form an oil-acid mixture in which the amount of oil employed comprises about 30 to 50 weight percent of the total amount of oil employed in the finished composition;
   (b) adjusting the oil and acid mixture to a temperature below about the boiling temperature of water;
   (c) adding slowly at a controlled rate of below about 0.30 lbs./minute a concentrated aqueous solution of approximately 8 to 10 weight percent of lithium hydroxide in an amount slightly in excess of that required to neutralize the acids;
   (d) maintaining the reaction conditions for a period of time sufficient to obtain substantially complete saponification between the fatty acids and lithium hydroxide;
   (e) dehydrating the mixture of lubricating oil and lithium complex soap;
   (f) heating the mixture until it is uniformly at a temperature of from about 390° F. to about 430° F.;
   (g) rapidly cooling the mixture to about 375° F. or below by quenching it with approximately 5 to 25 weight percent of the total amount of lubricating oil employed in the finished composition;
   (h) incorporating the remainder of the lubricating oil into the grease composition.

2. A process according to claim 1 in which any desired additives are incorporated into the grease mixture while the remainder of the lubricating oil is being incorporated into the mixture.

3. A process according to claim 1 which after step (h) also comprises milling the grease composition.

4. A process according to claim 1 wherein the hydroxy fatty acid has from 16 to 20 carbon atoms.

5. A process according to claim 1 wherein the hydroxy fatty acid is 12-hydroxy stearic acid.

6. A process according to claim 1 wherein the aliphatic dicarboxylic acid has from 6 to 10 carbon atoms.

7. A process according to claim 1 wherein the aliphatic dicarboxylic acid is azelaic acid.

8. A process according to claim 1 wherein in step (a) the fatty acids are dissolved in approximately 40 weight percent of the total base oil employed in the finished grease.

9. A process according to claim 1 wherein in step (a) the temperature at which the fatty acids are dissolved into the base oil is from about 240° F. to about 250° F.

10. A process according to claim 1 wherein in step (a) the mole ratio of hydroxy fatty acid to dicarboxylic acid ranges from 2:1 to 0.5:1.

11. A process according to claim 1 wherein in step (a) the mole ratio of hydroxy fatty acid to dicarboxylic acid is approximately 1.6:1.

12. A process according to claim 1 in step (b) wherein the oil and acid mixture is brought to about the 200° to 210° F. range.

13. A process according to claim 1 wherein in step (c) the rate of alkali addition is from about 0.05 to about 0.25 lb./minute per 100 lbs. of finished grease.

14. A process according to claim 1 wherein in step (c) the rate of alkali addition is approximately 0.15 lb./minute per 100 lbs. of finished grease.

15. A process according to claim 1 wherein in step (c) the mixture is slowly circulated during alkali addition.

16. A process according to claim 15 wherein the mixture is circulated during alkali addition at a rate of 1 lb/min circulated for every 2 to 10 lbs of mixture in the kettle.

17. A process according to claim 15 wherein the mixture is circulated during alkali addition at a rate of 1 lb/min circulated for every 2 to 5 lbs of mixture in the kettle.

18. A process according to claim 15 wherein the mixture is circulated during alkali addition at a rate of 1 lb/min circulated for about every 3 lbs of mixture in the kettle.

19. A process according to claim 1 wherein in step (f) the mixture is heated until it is uniformly at a temperature of from about 410° F. to about 420° F.

20. A process according to claim 1 wherein in step (g) the mixture is rapidly cooled to about 375° F. or below by quenching it with approximately 5 to 10 weight percent of the total amount of lubricating oil employed in the finished grease composition.

* * * * *

UNITED STATES PATENT AND TRADEMARK OFFICE

CERTIFICATE OF CORRECTION

PATENT NO. : 4,435,299

DATED : March 6, 1984

INVENTOR(S) : Don A. Carley, Arnold C. Witte, Jr., William B. Green, and Kermit W. Doerr It is certified that error appears in the above—identified patent and that said Letters Patent is hereby corrected as shown below:

Col. 6, line 2: after "minute" insert -- per 100 lbs of finished grease product --

Signed and Sealed this

Second Day of October 1984

[SEAL]

*Attest:*

*Attesting Officer*

GERALD J. MOSSINGHOFF

*Commissioner of Patents and Trademarks*